United States Patent [19]

Sansbury

[11] 4,343,427

[45] Aug. 10, 1982

[54] COMPOSITE CONTAINER WITH BALLOON FOLD

[75] Inventor: Jerry F. Sansbury, Hartsville, S.C.

[73] Assignee: Sonoco Products Company, Hartsville, S.C.

[21] Appl. No.: 131,098

[22] Filed: Mar. 18, 1980

[51] Int. Cl.[3] ..... B31C 3/04; B65D 3/04; B65D 3/22

[52] U.S. Cl. ..... 229/4.5; 206/524.8; 220/414; 220/435; 426/106; 493/294; 493/299

[58] Field of Search ..... 206/830, 524.8; 493/294, 299, 269; 229/4.5; 220/436, 414, 426, 415, 435; 53/289, 433, 453, 403; 426/118, 111, 128, 106

[56] References Cited

U.S. PATENT DOCUMENTS

| | | | |
|---|---|---|---|
| Re. 21,945 | 11/1941 | Schmidt . | |
| 768,107 | 8/1904 | Williams . | |
| 1,748,575 | 2/1930 | Maskey . | |
| 2,110,843 | 3/1938 | Schmidt . | |
| 2,214,330 | 9/1940 | Henderson et al. . | |
| 2,298,545 | 10/1942 | Waters . | |
| 2,349,730 | 5/1944 | Horning . | |
| 2,367,477 | 1/1945 | Waters . | |
| 2,681,284 | 6/1954 | Graves . | |
| 3,088,624 | 5/1963 | Kinshorn et al. . | |
| 3,156,401 | 11/1964 | Krause . | |
| 3,194,471 | 7/1965 | Murphy . | |
| 3,201,259 | 8/1965 | Galbierz et al. . | |
| 3,227,352 | 1/1966 | Striplin et al. . | |
| 3,279,675 | 10/1966 | Elan et al. . | |
| 3,315,864 | 4/1967 | Martin et al. . | |
| 3,397,834 | 8/1968 | Hanlon et al. | 206/830 X |
| 3,406,614 | 10/1968 | Martin et al. . | |
| 3,441,197 | 4/1969 | White . | |
| 3,467,244 | 9/1969 | Mahaffy et al. | 426/111 |
| 3,506,183 | 4/1970 | Tarpin et al. . | |
| 3,972,468 | 8/1976 | Reid . | |
| 3,981,433 | 9/1976 | Thornhill et al. | 229/4.5 X |
| 4,073,950 | 2/1978 | Hansen et al. . | |
| 4,091,718 | 5/1978 | Thornhill . | |
| 4,158,425 | 6/1979 | Sansbury . | |
| 4,286,745 | 9/1981 | Fukuoka | 229/4.5 |

OTHER PUBLICATIONS

International Publication No. WO 79/01113 to Kukuoka, 12/79.

*Primary Examiner*—Allan N. Shoap

*Attorney, Agent, or Firm*—Dennison, Meserole, Pollack & Scheiner

[57] ABSTRACT

A composite container capable of accommodating an internal vacuum environment within a tubular body of spirally wound paperboard or similar paperbase materials. A hermetically sealed liner is provided coextensive with the interior of the tubular body and adhesively secured thereto throughout substantially the full extent of the interior surface of the body. The liner is spirally wound, defining a spiral overlapped seam with the overlapping edge portion including an underfolded edge flap folded about a fold line prior to adhesive engagement with the overlapped edge portion. The seam fold thus formed has the interior thereof in direct communication with the paperbase body and is capable of ballooning inward, through the entire length thereof, upon generation of a vacuum atmosphere with the container. The vacuum atmosphere can thus be accommodated without affecting the structural integrity of the container. Lines of weakness are specifically avoided in the body plies by staggering the ply seams, offsetting the ply seams from the liner balloon seam, and providing at least some of the body plies with overlapped deckled or skived edges.

11 Claims, 6 Drawing Figures

COMPOSITE CONTAINER WITH BALLOON FOLD

BACKGROUND OF THE INVENTION

The present invention is generally concerned with lined composite can construction, and more particularly with the construction of composite cans in a manner so as to accommodate a reduced internal pressure or an internal vacuum environment.

Substantial advantages of both an economic and environmental nature reside in the use of composite containers as opposed to the more traditional glass and metal containers. Such advantages include reduced expenses both in the materials used and in the procedures involved in the manufacture of the container. Also, and of particular significance, is the fact that composite containers are, to a large extent, biodegradeable and easily disposed of without adversely affecting the environment. However, the use of composite containers is, to an appreciable degree, limited because of the lack of inherent strength in such containers.

A particular area of difficulty is the packaging of products which either inherently produce or require the formation of an internal vacuum environment. As a specific example, in the hot filling of lined composite containers of conventional construction with single strength juice, such as orange, grapefruit and grape juices, there is a substantial likelihood of the cans imploding. The hot filling of these juices into the containers involves direct introduction of the juice from the pasteurizing apparatus into the cans at a liquid temperature of from 190° to 200° Farenheit. After filling, the tops are applied and seamed to the cans and the cans subsequently cooled to less than 100° Farenheit. This cooling creates an internal vacuum of approximately 15 inches of mercury. The pressure differential created by the vacuum environment formed within the can in turn give rise to a very substantial likelihood the can or container will implode. At the very least, air under the higher external or ambient pressure will seep through the fibrous body of the can and act directly against the inner hermetic foil liner. This pressure against the liner, even when provided with a kraft paper backing, will cause a tearing of the liner away from the fibrous body, resulting in an uncontrolled inward blistering, or in fact rupturing, of the liner.

A further discussion of the desirability of the use of composite cans, the problems inherent therein when dealing with vacuum packaging, and one solution for the accommodation of vacuum packaging in composite cans, will be found in Applicant's prior U.S. Pat. No. 4,158,425, the disclosure of which is incorporated herein by reference.

SUMMARY OF THE INVENTION

The present invention proposes composite can construction particularly adapted for accommodating hot fill single strength juices which inherently generate a reduced internal pressure or vacuum environment when following conventional can filling procedures. The proposed construction is compatible with the use of available spiral winding apparatus and conventional composite container forming materials including paperbase body plies, outer labels of any appropriate material, an inner hermetic liners normally formed of metallic foil backed by strengthening kraft paper and, if desired, faced by thin plastic film for enhancing the air impermeable nature thereof.

The accommodation of the internal vacuum is provided for by forming the liner in a manner whereby a controlled inward ballooning of the selected portion of the liner takes place. This inward ballooning, while sufficient to accommodate the pressure differential without destruction of the liner, does so in a manner whereby substantially the entire liner remains firmly adhered to the inside of the fibrous body wall. In this manner, a stable product confining interior is retained.

In order to provide for the desired controlled inward ballooning of a selected portion of the liner, the spirally formed seam is provided with an excess fold, the interior of which is in direct communication with the multiply paperbase body. The fold is formed by a reverse or underfolding of a full length edge flap of the overlapped liner edge provided as a result of the spiral winding of the liner. The underfolded edge flap is thus positioned with the foil facing thereof in direct contact with the foil facing of the immediately underlying edge portion. A continuous full-length adhesive bond in provided between these facing edge surfaces with the fold extending beyond the area of adhesive bonding into free overlying relation with the area of the liner immediately adjacent the bonded portion edge surfaces.

The back face of the liner is bonded along substantially the entire surface thereof to the inner face of the body as the body plies are spirally wound about the initially formed liner. The only area wherein there is no direct bonding between the liner and the body is immediately outward of the adhesive bond between the overlying edges for a narrow width which extends along the full length of the seam. In this manner direct communication is provided between the body plies and the interior of the excess fold. This unbonded area may actually be formed by the minute spacing provided immediately adjacent the overlapping edges when the innermost edge portion is slightly inwardly offset from the body plies to achieve the overlap.

The unbonded area provides a specific air passage to the interior of the excess fold whereby air permeating the body plies, because of the vacuum generated pressure differential, will pass into and inwardly balloon the excess fold. This will enable an effective reduction in both the excess area within the can and the pressure generating vacuum in a controlled manner along the full length and around the circumference of the can without any danger of imploding, rupture of the liner, contamination of the product, or leakage.

It is considered particularly significant that the basic structural integrity of the can be maintained constant throughout the full extent thereof, with there being no inherent lines of weakness, notwithstanding the provision of a ballooning fold within the liner itself. Accordingly, it is specifically provided that the liner seam, with excess fold, be substantially offset from the body ply seam or seams. In turn, the body seams are to be bonded, and in some or all instances actually skived or deckled, in a manner whereby the body forms a constant strength tubular construction throughout the length thereof. As an additional expedient, if deemed desirable, the outer or labeled ply can also have the seam thereof offset from both the body ply seams and the liner seam.

It is believed additional objects and advantages will become apparent from the following more detailed description of the construction involved in the present invention.

DESCRIPTION OF THE PREFERRED EMBODIMENT

Figure 1:
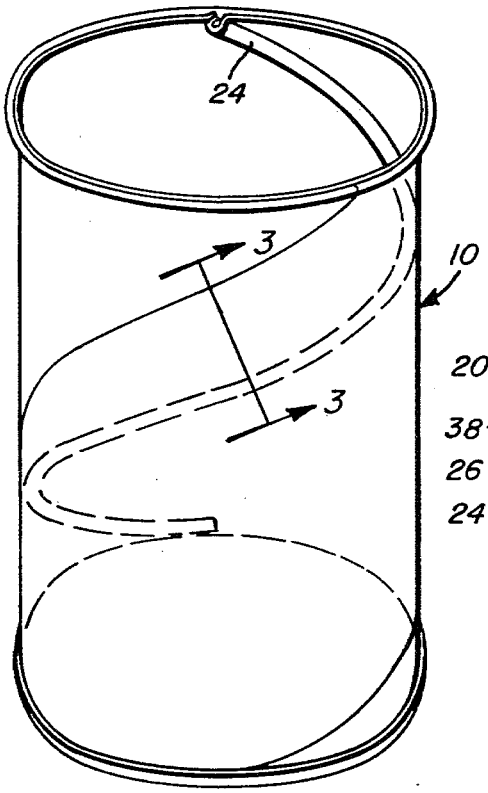
FIG. 1 is a perspective view of a container or can, with the top removed, formed in accordance with the present invention and illustrating the balloon fold in its expanded position.

Referring now more specifically to the drawings, reference numeral 10 is used to generally designate a composite can constructed in accordance with the present invention. Noting the cross-sectional details of FIGS. 2 and 3, the construction of the container involves the provision of a paperboard or paperbase body 12 formed of at least one and normally multiple spirally wound plies provided with edge seams 14 specifically formed to provide a high degree of structural integrity whereby the body of the can will be of substantially equal strength through the full extent thereof. This provision of a full strength seam will normally involve a direct bonding of the seam edges and an actual skiving or deckling of all or selected ones of the body ply edges for a positive overlapped bonding thereof. Finally, the edge seams of the individual body plies can be slightly staggered relative to each other to avoid a direct stacking thereof and thus enhance the strength of the body. An appropriate label or finishing ply 16 will normally be spirally formed about the exterior of the body 12 and intimately bonded thereto by an appropriate adhesive layer 18.

The wall construction of the container or can 10 is completed by the internal liner 20, the structural uniqueness of which, in conjunction with the relationship to the multi-ply body 12, contributes significantly to the invention and the advantages flowing therefrom.

The liner 20 is to be of material capable of providing a hermetic seal for the interior of the can. As such, an appropriate liner would comprise a metallic foil directed inward toward the interior of the can with a strengthening backing of kraft paper or the like bonded thereto and adapted to be in turn bonded to the inner surface of the body 12. If deemed desirable, an appropriate plastic film can be provided over the foil face to further enhance the impermeability thereof.

The liner 20 is spirally formed with the edges thereof overlapped and hermetically sealed.

Figure 2:
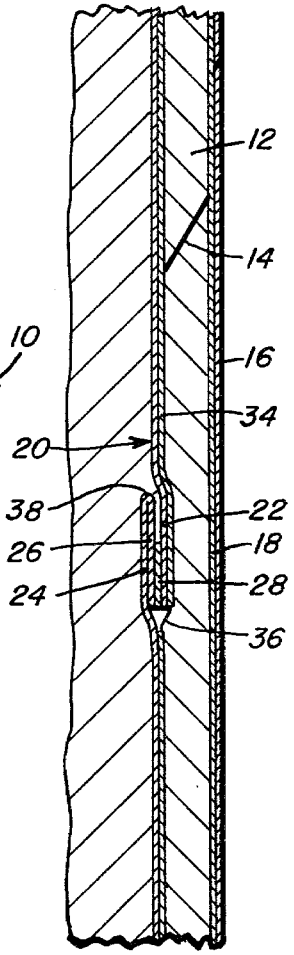
FIG. 2 is an enlarged cross-sectional detail through the can structure illustrating the balloon fold prior to the expansion thereof in response to an internally generated vacuum.
Figure 3:
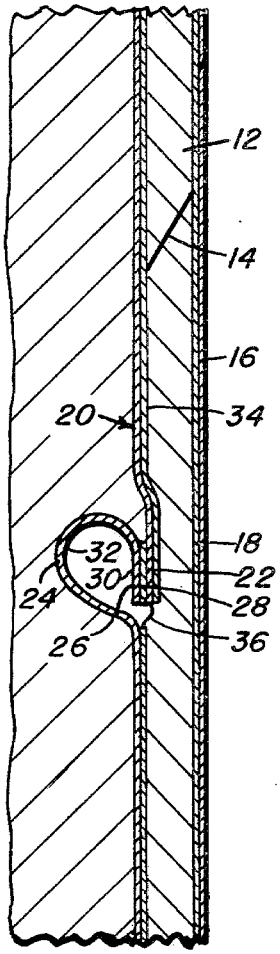
FIG. 3 is a view similar to FIG. 2 with the fold in its inwardly expanded or ballooned position.

Noting FIG. 2 in particular, the overlapped liner edge portions include, relative to the interior of the can, an underlying outer edge portion 22 and an overlying inner edge portion 24. The overlying inner edge portion 24 has an extreme edge flap 26 along the full length thereof folded under whereby the foil face of this overlying edge flap faces the foil or inner surface of the underlying edge portion 22. The facing foil surfaces are hermetically sealed along the full length thereof by an appropriate adhesive stripe or other bonding means 28. The inner facing surfaces 30 and 32 between the folded edge flap 26 and the corresponding edge portion 24 remain unbonded and free to move relative to each other as will be best appreciated from a comparison of FIG. 3 with FIG. 2. In addition, it will be noted that the width of the band of adhesive 28 is relatively narrow when compared to the width of the underlying flap 26, this band 28 being only sufficient to provide for a positive hermetic sealing of the edge portions. The underlying flap 26 itself projects in free overlying relation to the underlying edge portion 22 beyond the adhesive band 28 to provide a predetermined amount of excess material to achieve the desired ballooning as shall be explained subsequently.

The liner 20 is adhesively secured or otherwise bonded as at 34, to the interior surface of the body 12 throughout the full extent of the engaging surfaces thereof except for a narrow area 36 extending along the full length of the formed seam immediately outward of the free edge of the folded edge flap 26, opposed from the fold line 38 itself, and in direct communication with the interior of the fold between the unsecured faces thereof. This enables passage of air through the porous multi-ply body, through the full length area 36, and into the fold for effecting an inward ballooning thereof as will be best noted in FIG. 3. As a matter of manufacturing expedience, the narrow unbonded area 36 may be formed by the slight inward offsetting of the inner edge portion 24 necessary so as to effect an overlapping of the outer edge portion 22. While the plies of the body 12 may be slightly compressed during the construction of the can, as will be noted by the slight offset illustrated in FIGS. 2 and 3, this will not be sufficient to bring the overlapping edge portion 24 into bonding engagement with the inner surface of the body 12 immediately adjacent the underlying edge portion 22, thus ensuring the provision of the required narrow unbonded area 36.

Figure 6:
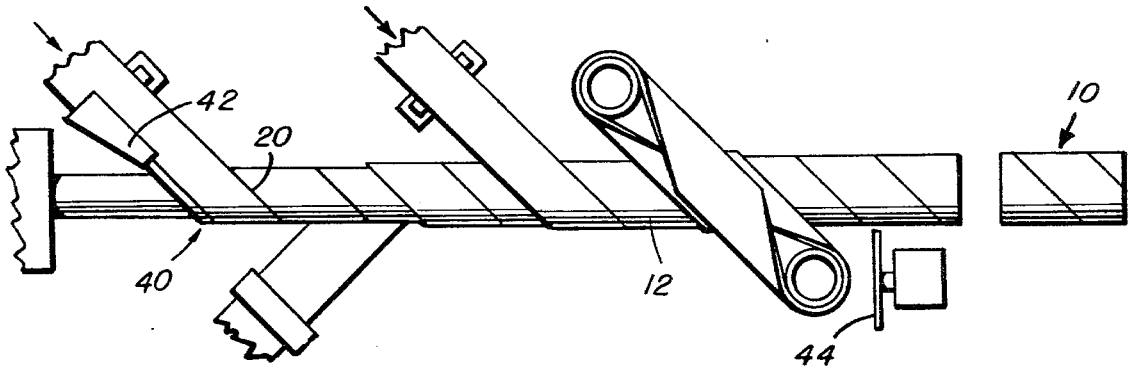
FIG. 6 is a schematic illustration of the formation of a can in accordance with the present invention.

The actual construction of the can 10 will normally be effected on substantially conventional spiral winding apparatus 40 as suggested in FIG. 6. This will involve an initial spiral winding of the liner 20, including the folding of the liner edge as at 42, for a forming of the seam with the excess fold therein. The formation of the liner will, as a continuing process, be followed by a spiral winding of the multiple plies which constitute the body 12 with the body ply seams offset from the liner seam. This in turn may be followed by a spiral winding of the cover ply or label. The product thus produced is a continuous tubular construction from which the individual cans are severed as at 44. An end plate or cap is sealed to one end of each of the individual cans and, at some later stage, the product introduced into the can and the second end thereof sealed. Until such time as the can is finally sealed with the product therein and the vacuum generated, the seam remains in its flattened condition as illustrated in FIG. 2.

As previously referred to, the can of the present invention is particularly intended for use with products packed under vacuum conditions or conditions whereby an internal vacuum environment is produced.

Figure 4:
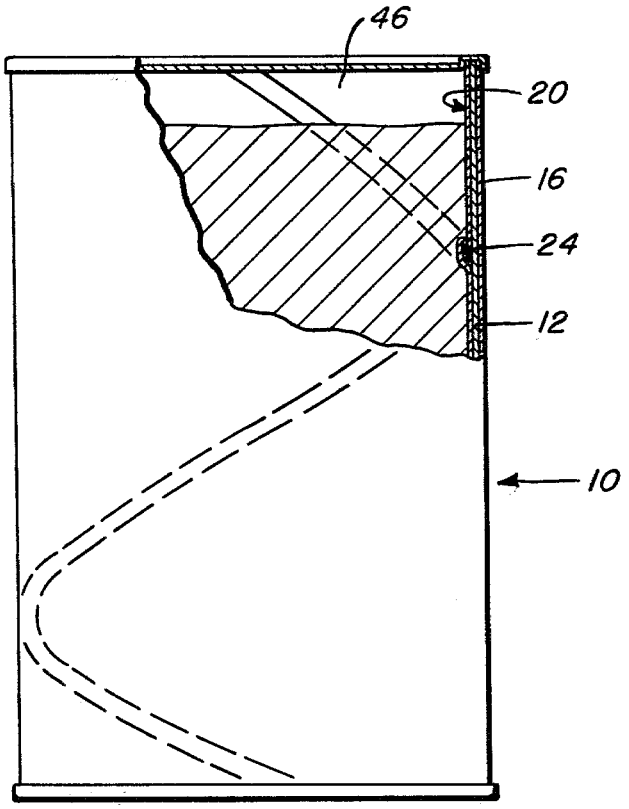
FIG. 4 is a side elevational view, with a portion broken away, illustrating a can immediately upon the filling and sealing thereof with the inherently provided head space and the unexpanded seam fold.

A primary example of this is single strength juices such as orange, grapefruit and grape juices which are filled into cans from pasteurizing apparatus at a liquid temperature of approximately 190° to 200° Farenheit. After filling, the open end is hermetically sealed, involving a seaming procedure wherein the impermeable lid directly seals to the liner itself. Next, the individual cans are cooled down to less than 100° Farenheit. This creates an internal vacuum of approximately 15 inches of mercury. FIG. 4 generally illustrates a can filled as above immediately subsequent to the sealing of the can and prior to the cooling thereof. It will be noted that, as is conventional in filling containers with products of all types, and in particular juices, a head space 46 remains.

The generation of an internal vacuum environment produces a substantial pressure differential between the interior and exterior of the can. This pressure differential is so great as to cause, or at least give rise to the substantial possibility of causing, an implosion of composite cans of conventional construction. Even were the can body of sufficient stability to withstand imploding, air seeping under pressure through the paperbase body 12 would cause an inward blistering and/or rupturing of the air impermeable liner. The aforedescribed excess fold seam is specifically provided to accommodate the pressure differential and avoid a destructive disruption of the can or liner. This accommodation of the pressure differential is achieved without affecting the structural integrity of the container, without affecting the appearance of the container, and in a manner which more completely accommodates the product to the container, producing a firmer and more structurally stable package.

Figure 5:
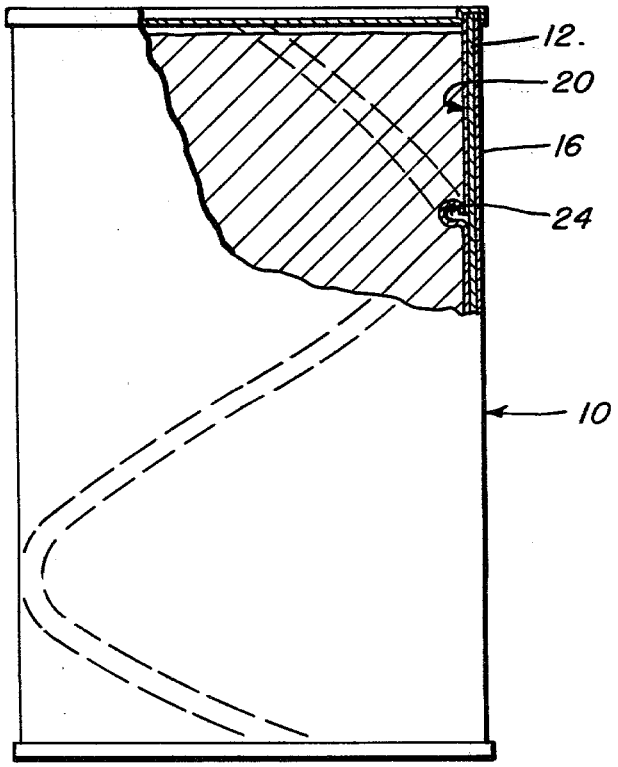
FIG. 5 is a view similar to FIG. 4 wherein the internal vacuum, and hence the developed pressure differential, has effected an expansion of the balloon fold and an accommodation of the product in the initially provided head space.

After a complete sealing of the can and a cooling thereof, the resultant pressure differential will result in the condition illustrated in FIG. 5. More specifically, there will be a pressure induced seepage of air inwardly through the paperboard body 12 and through the spiral unbonded area 36, immediately at the excess fold seam, into the interior of the excess fold. This will cause a controlled inward ballooning of the fold along the full length of the spiral seam between the opposed end cap sealed ends thereof. The inward ballooning of the fold will be symmetrically provided both circumferentially and longitudinally about the container interior. The liquid or product displaced by the inward ballooning fold will be accommodated in the initially provided air head space above the liquid, with the inward controlled ballooning of the liner fold causing an effective reduction of the vacuum level and a relieving of the pressure differential, which in turn eliminates any possibility of container implosion or liner rupture. This in turn avoids any problems with regard to product leakage, contamination, or the like.

The amount of excess liner fold, that is the width of the fold, required is dependent upon the filled height of the liquid product and the resultant air head space remaining in the can between the can end and the liquid level. The following chart illustrates the width of excess fold required to completely void the vacuum created for various head space heights and volumes in different comtemplated hot filled cans:

| Can size | Head Space Height (Inches) | Head Space Volume (Cubic Inches) | Excess Fold (Inches width required) |
|---|---|---|---|
| 202 × 314 (6oz.) | .125 | .416 | .467 |

-continued

| Can size | Head Space Height (Inches) | Head Space Volume (Cubic Inches) | Excess Fold (Inches width required) |
|---|---|---|---|
| " | .1875 | .624 | .572 |
| " | .250 | .832 | .660 |
| " | .375 | 1.247 | .810 |
| " | .500 | 1.663 | .933 |
| 211 × 413 (12oz.) | .125 | .649 | .500 |
| " | .1875 | .973 | .618 |
| " | .250 | 1.297 | .715 |
| " | .375 | 1.946 | .875 |
| " | .500 | 2.595 | 1.00 |
| 404 × 700 (46oz.) | .125 | 1.687 | .594 |
| " | .1875 | 2.53 | .728 |
| " | .250 | 3.37 | .841 |
| " | .375 | 5.06 | 1.03 |
| " | .500 | 6.747 | 1.189 |

From the foregoing, it will be appreciated that a unique system has been devised for enabling the utilization of composite cans, of basically conventional strength, so as to accommodate products wherein a vacuum generated pressure differential is involved. Such a pressure differential, in the conventional can and without the features of the present invention, would, upon the generation of an internal vacuum, quite likely cause and can to implode, deform, rupture, leak or otherwise fail. Such problems are avoided by the comtemplated provision of a ballooning fold within the liner seam assembly, in conjunction with a container body wall which is of substantially constant strength, without lines of weakness, and capable of effectively retaining the product therein in the absence of excess pressure differentials.

In order to insure the structural integrity of the can, and in fact the complete package, specific provision is made to offset the liner seam from the seam or seams of the body ply or plies. In this manner, there is an avoidance of any weakness which might develop because of a stacked alignment of the seams, notwithstanding the aforementioned intention that the seams of the body plies be so constructed as to possess an inherent strength equal to that of the body itself remote from the seams thereof.

The foregoing is considered illustrative of the principals of the invention. As modifications may occur to those skilled in the art, it is not desired to limit the invention to the exact embodiment or a manner of construction as shown and described. Accordingly, all suitable modifications and equivalents are considered appropriate within the scope of the invention as claimed.

I claim:

1. In a composite container adapted to accommodate a reduced internal pressure, an elongated self-sustaining body having opposed ends and inner and outer surfaces, a hermetic liner within said body substantially coextensive with and bonded to the inner surface thereof to define a hermetic seal, said liner including an integral inflatable fold formed therein spirally about the inner surface of the body along the length of said body between the opposed ends and being of generally constant width, said fold, along the full length thereof, including a first flap overlying said liner, a second flap overlying said first flap in unbonded relation to said first flap and connected thereto by a fold line, said first flap having a first portion along the length thereof adjacent said fold line and in unbonded free overlying relation to said liner and having a second portion adjacent said first portion and fixedly secured to said liner, the fixedly secured portion being substantially narrower than the width of said first flap and remote from said fold line, said first portion, said fold line, and said second flap forming a continuous section in unbonded free overlying relation to the liner and defining means for inward ballooning relative to the fixed second portion, the liner, and the inner surface of the body upon development of a reduced pressure environment within the container, and without disruption of the hermetic liner.

2. The container of claim 1 wherein said body is cylindrical and of a substantially constant structural strength throughout the full extent thereof.

3. The container of claim 2 wherein said liner is defined by a spiral wrap of an impermeable liner material having opposed overlapped liner edge portions, a first one of said liner edge protions being bonded to the body, said second liner edge portion overlying said first liner edge portion and being reversely folded and forming said first and second flaps, said first flap including a free edge bonded to said first liner edge portion to define the fixed second portion of the first flap.

4. The container of claim 3 wherein said liner is bonded to the inner surface of said body over substantially the full area of engagement with said body other than for a narrow width along and immediately outward of the free edge of the first flap to define an air passing opening between the body and the interior of the fold.

5. The container of claim 4 wherein said body is formed of at least one spiral ply of paperbase material having bonded edges offset from the sealed edge portions of the liner.

6. The container of claim 5 wherein the bonded edges of the body ply are of a structural integrity generally equal to that of the remainder of the body.

7. The container of claim 6 wherein the body is formed of multiple body plies, at least one of which has skived bonded edges.

8. In a composite container adapted to accommodate a reduced internal pressure, an elongated self-sustaining body having opposed ends and inner and outer surfaces, a hermetic liner within said body substantially coextensive with and bonded to the inner surface thereof to define a hermetic seal, said liner including opposed overlapped liner edge portions sealed to each other, a first one of said liner edge portions being bonded to the body, the second liner edge portion overlying said first liner edge portion and being reversely folded along a fold line to form a first flap of generally constant width overlying the first liner edge portion and a second flap overlying said first flap in unbonded relation thereto, said first flap including a free edge, said first flap, along a band adjacent the free edge thereof, being bonded to said first liner edge portion, said band being substantially narrower than said first flap, the remainder of said first flap being unbonded to and freely overlying the remainder of said first liner edge portion, said second liner edge portion from the bonded band through the fold line and second flap being free for inward ballooning relative to the bonded first liner edge portion.

9. A method of forming a composite can capable of accommodating an internal reduced pressure comprising the steps of spirally forming an air impermeable material into a liner defining configuration with a first edge portion and a second overlapping edged portion, each edge portion including a free edge, forming an inflatable fold along said second edge portion by a reverse folding of said second edge portion along a fold line to define an underlying flap and an overlying flap, bonding said underlying flap adjacent the free edge of said second edge portion to the first edge portion to define a band of attachment substantially narrower than said underlying flap, retaining the second edge portion, from the band of attachment through the fold line, in unbonded overlying relation to the first edge portion, retaining said underlying flap in unbonded underlying relation to the overlying flap, and retaining air passage means to the interior of the fold along the length thereof, spirally forming a body of paperbase material completely about said liner and in overlying relation to said air passage means to the interior of the fold, bonding said body to said liner throughout the full area of surface contact between the body and liner except for said air passage means whereby the generation of a relatively lower pressure within the liner will result in an induced air flow through said body and into the fold to effect an inflation thereof.

10. The method of claim 9 wherein the body is formed with seams therein remote from the liner seam defined by the overlapped edge portions.

11. The method of claim 10 wherein the seams of the body are formed so as to approximate the structural integrity of the remainder of the body.

* * * * *